US007368419B2

(12) United States Patent
Boehme et al.

(10) Patent No.: US 7,368,419 B2
(45) Date of Patent: May 6, 2008

(54) DISHWASHING DETERGENT CONTAINING GLYCEROL HYDROXYALKYL ETHERS

(75) Inventors: Corinna Boehme, Dormagen (DE); Hans-Christian Raths, Monheim (DE); Manfred Weuthen, Langenfeld (DE); Thomas Albers, Duesseldorf (DE)

(73) Assignee: Cognis IP Management GmbH, Duesseldorf (DE)

( * ) Notice: Subject to any disclaimer, the term of this patent is extended or adjusted under 35 U.S.C. 154(b) by 100 days.

(21) Appl. No.: 11/245,737

(22) Filed: Oct. 7, 2005

(65) Prior Publication Data

US 2006/0089295 A1 Apr. 27, 2006

(30) Foreign Application Priority Data

Oct. 7, 2004 (DE) ..... 10 2004 048 779

(51) Int. Cl.
*C11D 1/66* (2006.01)
*C11D 3/20* (2006.01)
*C11D 3/43* (2006.01)

(52) U.S. Cl. ..... 510/506; 510/220; 510/226; 510/392; 510/475; 510/521; 510/535

(58) Field of Classification Search ..... 510/220, 510/226, 392, 475, 506, 521, 535
See application file for complete search history.

(56) References Cited

U.S. PATENT DOCUMENTS 3,427,248 A * 2/1969 Lemair et al. ..... 510/127
6,919,305 B2 7/2005 Kischkel et al.
2003/0008801 A1* 1/2003 Raths et al. ..... 510/421

FOREIGN PATENT DOCUMENTS

| | | |
|---|---|---|
| DE | 290 0 030 | 7/1980 |
| DE | 44 01 235 | 7/1995 |
| DE | 1 0152142 | 4/2003 |
| EP | 0 113 798 | 7/1984 |
| EP | 0 303 187 | 2/1988 |
| EP | 1 411 112 | 4/2004 |

* cited by examiner

*Primary Examiner*—Brian Mruk
(74) *Attorney, Agent, or Firm*—John F. Daniels; Richard A. Elder

(57) ABSTRACT

Compositions comprising glycerol hydroxyalkyl and/or hydroxyalkenyl ethers, which correspond to the general formula:

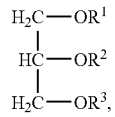

in which $R^1$, $R^2$ and $R_3$, independently, represent a hydrogen atom or a saturated or unsaturated, branched or unbranched hydroxyalkyl or hydroxyalkenyl group, or mixtures thereof, each group containing 10 to 22 carbon atoms, and the use of these, particularly, glycerol hydroxyalkyl mono- and di-ethers in detergents and as rinse agents for automatic dish detergents, particularly for multifunctional dish detergents.

11 Claims, No Drawings

DISHWASHING DETERGENT CONTAINING GLYCEROL HYDROXYALKYL ETHERS

CROSS-REFERENCE TO RELATED APPLICATIONS

This application claims priority under 35 U.S.C. § 119 from German Patent Application No. 10 2004 048 779.0, filed on Oct. 7, 2004.

BACKGROUND OF THE INVENTION

This invention relates to automatic dishwashing detergents containing polyol hydroxyalkyl ethers and to the use of polyol hydroxyalkyl ethers in rinse agents or detergents, preferably for automatic dishwashing.

Rinse agents are normally mixtures of low-foaming nonionic surfactants, typically fatty alcohol polyethylene/polypropylene glycol ethers, solubilizers (for example cumenesulfonate), organic acids (for example citric acid) and solvents (for example ethanol). The function of these compositions is to influence the interfacial tension of the water in such a way that it is able to drain from the tableware in the form of a thin, coherent film, so that no water droplets, streaks or films remain behind after the subsequent drying step. However, there is a constant demand for improved clear rinse performance. In addition, an increasing number of multifunctional detergent formulations have come onto the market in recent years. Besides a cleaning function, they are also expected to perform at least one additional useful function, for example as rinse agents and/or as water softeners (so-called 2-in-1 or 3-in-1 products). Combined products of dishwashing detergent and "built-in" rinse agent are being increasingly used both in the home and in the institutional sector. In domestic dishwashers, rinse agents are generally added separately before the cleaning process and are released into the tank of the dishwasher after the prerinse and cleaning cycle at 40 to 65° C. With combined dishwasher detergents (for example 2-in-1 or 3-in-1 tablets or powders), the rinse agent is formulated together with the detergents, but is released in such a way that it only develops its effect in the final rinse cycle which makes the detergents easier to handle and dose.

Against the background of these new formulations, there was a need to develop alternative rinse agents which would meet the requirements of multifunctional products without any reduction in their clear rinse performance. The alternative rinse agents would also have to be more efficient.

The problem addressed by the present invention was to provide rinse agents with improved clear rinse performance which, at the same time, could also be formulated as multifunctional products.

BRIEF SUMMARY OF THE INVENTION

The invention relates to compositions of, particularly, glycerol hydroxyalkyl and/or hydroxyalkenyl mono- and di-ethers, and to their use in detergents and as rinse agents for automatic dish detergents, particularly for multifunctional dish detergents. Preferred glycerol hydroxyalkyl and/or hydroxyalkenyl ethers correspond to the general formula:

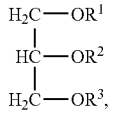

in which $R^1$, $R^2$ and $R^3$, independently, represent a hydrogen atom or a saturated or unsaturated, branched or unbranched hydroxyalkyl or hydroxyalkenyl group containing 10 to 22 carbon atoms, or mixtures thereof.

DETAILED DESCRIPTION OF THE INVENTION

In a first embodiment, the present invention relates to rinse agents containing at least a) water, b) a water-insoluble polyol hydroxyalkyl ether of which the alcohol component contains at least 2 and at most 6 hydroxyl groups and 3 to 6 carbon atoms and of which the alkyl group is selected from saturated and/or unsaturated, branched or unbranched hydroxyalkyl or hydroxyalkenyl groups containing 10 to 22 carbon atoms, preferably 2-hydroxyakyl groups, and c) a solubilizer and optionally d) an acid, preferably an organic acid.

The rinse agents according to the invention are characterized by their content of polyol hydroxyalkyl ethers b). Such ethers are known, cf. the disclosure of U.S. Pat. No. 3,427,248. The polyol hydroxyalkyl ethers according to the invention have a (poly)alcohol component and one or more alkyl groups of which each bears at least one free hydroxyl function, preferably in the 2-position of the chain. Such compounds according to the invention are produced, for example, by reaction of an α-alkyl epoxide with a polyol, preferably glycerol, at elevated temperatures in the presence of acidic or basic catalysts, preferably potassium or sodium hydroxide. Preferred reaction temperatures are in the range from 180° C. to 250° C. and more particularly in the range from 200° C. to 220° C. An alkaline catalyst preferably used can be neutralized after the reaction by addition of an organic acid, preferably lactic acid.

The polyol component of the polyol alkyl ether is preferably selected from the group consisting of butanediol, pentanediol, hexanediol, glycerol, diglycerol, neopentyl glycol, pentaerythritol and trimethylol propane. The preferred polyol for the purposes of the present technical teaching is glycerol. The hydroxyalkyl group of the polyol ether is preferably selected from saturated and/or unsaturated, branched or unbranched hydroxyalkyl or hydroxyalkenyl groups containing 10 to 22, preferably 10 to 18 and more particularly 10 to 16 carbon atoms. Saturated hydroxyalkyl or hydroxyalkenyl groups containing 10 to 18 and preferably 10 to 16 carbon atoms are particularly preferred. Compositions containing polyol hydroxyalkyl ethers based on unbranched, saturated alkyl groups are also preferred. From the production perspective, hydroxyalkyl or hydroxyalkenyl groups where the free OH function is in the 2-position are preferred.

The polyol hydroxyalkyl ethers used in accordance with the invention preferably correspond to general formula (I):

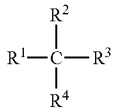

(I)

In which $R^1$, $R^2$, $R^3$ and $R^4$ independently of one another represent $OR^5$, $CH_2$—$OR^5$, OH, $CH_3$, $C_2H_5$ or H. The substituents $R^5$ independently of one another represent a hydrogen atom or a saturated, unsaturated, branched or unbranched hydroxyalkyl or hydroxyalkenyl group containing 10 to 22, preferably 10 to 18 and more particularly 10 to 16 carbon atoms. $R^5$ is preferably a substituent $R^6$—COH—$CH_2$—, where $R^6$ is an alkyl or alkenyl group containing 8 to 20 and preferably 8 to 14 carbon atoms.

The polyol hydroxyalkyl ethers may also contain mixtures of the various hydroxyalkyl or hydroxyalkenyl groups alongside one another. In addition, the polyol hydroxyalkyl ethers used in the compositions according to the invention may be completely or partly etherified. Mixtures of partly and completely etherified polyol hydroxyalkyl ethers may also be used. However, there has to be at least one free OH function—as described above—in the alkyl ether group. A small percentage of unetherified polyols—typically not exceeding 5 to 10% by weight, based on the quantity of ether—may also be present from the production process. Particularly preferred polyol hydroxyalkyl ethers are the corresponding glycerol monoethers and/or diethers, in which case the alkyl group contains 10 to 18 and preferably 10 to 18 carbon atoms. Compounds containing only saturated, unbranched hydroxyalkyl or hydroxyalkenyl groups are preferred.

The polyol hydroxyalkyl ethers used in the compositions according to the invention are preferably insoluble in water, i.e. only at most 10% by weight, preferably at most 5% by weight and more particularly at most 2% by weight dissolve in water at 21° C. Accordingly, solubilizers c) are preferably added for the formulation of water-containing systems. Solubilizers are generally interfacially active substances which, through their presence, dissolve compounds substantially insoluble in a certain solvent, or make them emulsifiable, in that solvent (solubilization). A particularly preferred solubilizer is cumene sulfonate. However, other solubilizers, for example the unbranched $C_{6-10}$ n-alkyl sulfates disclosed in DE 44 01 235, are also suitable. Other suitable solubilizers are short-chain aliphatic alcohols such as, for example, ethanol, propanol or butanol or isomers thereof, because these compounds also have a solubilizing effect and, accordingly, may be used as component c) for the purposes of the present teaching.

The water-containing rinse agents according to the invention may also contain non-aqueous solvents, more particularly polyethylene glycols, preferably with molecular weights of 600 to 35,000 or mixtures thereof.

The use of an acid d) in the rinse agents according to the invention is optional, but preferred. Organic (carboxylic) acids are particularly suitable. Suitable organic di- or tricarboxylic acids containing 2 to 6 carbon atoms are, for example, malic acid, tartaric acid, oxalic acid, malonic acid, succinic acid, glutaric acid, adipic acid, but especially citric acid. Mixtures of different individual substances of groups a), b), c) and/or d) or e) are also suitable for the purposes of present technical teaching.

The rinse agents may also contain other typical auxiliaries and additives, more particularly surfactants including nonionic, anionic, cationic and zwitterionic surfactants. The use of nonionic surfactants, for example from the group of fatty alcohol alkoxylates, preferably fatty alcohol ethoxylates, hydroxy mixed ethers and alkyl (oligo)glycosides, is preferred.

In the first embodiment, the rinse agents according to the invention contain water, their water content being in the range from 10 to 90% by weight, based on the rinse agent. The aqueous rinse agents contain the polyol hydroxyalkyl ethers in quantities of preferably 0.01 to 25% by weight, more preferably 1 to 15% by weight and most preferably 2 to 10% by weight. The solubilizer is present in quantities of 1 to 25% by weight and preferably 1 to 5% by weight while the non-aqueous solvent is present in quantities of 1 to 50% by weight and preferably in quantities of 1 to 35% by weight. The acids are typically present in quantities of up to 10% by weight.

The rinse agents according to the invention are normally introduced separately into the dishwashing machine. However, they are also suitable for incorporation as compounds, for example in liquid cleaning formulations, more particularly dishwashing detergents and preferably automatic dishwasher detergents.

The present invention also relates to compositions containing polyol hydroxyalkyl ethers as described above, at least one enzyme and at least one bleaching agent and optionally other auxiliaries and additives. The compositions may be both solid and liquid or gel-form compositions, solid compositions being preferred. These liquid or solid compositions contain the polyol alkyl ethers as a rinse agent. The compositions are typically automatic dishwasher detergents, more especially those with multifunction properties. The compositions preferably contain the polyol hydroxyalkyl ethers according to the invention in quantities of 0.01 to at most 50% by weight. A preferred range is from 1 to 35% by weight. Besides the presence of the polyol hydroxyalkyl ethers, the presence of at least one enzyme and at least one bleaching agent is compulsory.

Suitable enzymes are those from the class of proteases, lipases, amylases, cellulases or mixtures thereof. Enzymes obtained from bacterial strains or fungi, such as Bacillus subtilis, Bacillus licheniformis and Streptomyces griseus are particularly suitable. Proteases of the subtilisin type, particularly proteases obtained from Bacillus lentus, are preferably used. Mixtures of enzymes may also be used. The percentage content of enzymes may be from about 0.1 to 10% by weight and is preferably from 0.2 to 5% by weight. In another advantageous embodiment, however, the compositions may contain 0.2 to 6% by weight or 1 to 5% by weight of enzymes. The enzymes may be adsorbed onto carriers or encapsulated in membrane materials to protect them against premature decomposition.

Suitable bleaching agents are borates, peroxide compounds and chlorine-containing bleaching agents which may be used individually or in comb Among the compounds acting as peroxy bleaching agents, sodium perborate tetrahydrate and sodium perborate monohydrate are particularly important. Other bleaching agents are, for example, peroxycarbonate, citrate perhydrates and $H_2O_2$-yielding peracidic salts of the per acids, such as perbenzoates, peroxyphthalates or diperoxydodecanedioic acid. They are normally used in quantities of 0.1 to 40% by weight. Sodium perborate monohydrate in quantities of 5 to 20% by weight and more particularly 5 to 15% by weight is preferably used.

The use of sodium percarbonate in combination with alkyl and/or alkenyl oligoglycosides is also preferred.

The detergents according to the invention of the second embodiment may contain, for example, solubilizers as described above, but more particularly lower alcohols, such as ethanol, isopropyl alcohol, ethylene glycol, propylene glycol, butyl glycol, diethylene glycol, propylene glycol monobutyl ether, polyethylene or polypropylene glycol ether, preferably with molecular weights of 600 to 50,000, more particularly up to 35,000, or more especially butyl diglycol as further typical ingredients or auxiliaries and additives. Relatively high molecular weight polyethylene glycols with molecular weights of 4,000 to 6,000 are particularly preferred.

In many cases, an additional bactericidal effect is required, so that the detergents may contain cationic surfactants or biocides, for example glucoprotamine. Suitable builders are zeolites, layer silicates, phosphates and ethylenediamine tetraacetic acid, nitrilotriacetic acid, citric acid and salts thereof and inorganic phosphonic acids and derivatives thereof.

Suitable thickeners are, for example, hydrogenated castor oil, salts of long-chain fatty acids which are preferably used in quantities of 0.1 to 5% by weight and more particularly in quantities of 0.5 to 2% by weight, for example sodium, potassium, aluminium, magnesium and titanium stearates or the sodium and/or potassium salts of behenic acid and other polymeric compounds. These other polymeric compounds are preferably polyvinyl pyrrolidone, urethanes and the salts of polymeric polycarboxylates, for example homopolymeric or copolymeric polyacrylates, polymethacrylates and in particular copolymers of acrylic acid with maleic acid, preferably those of 50 to 10% by weight maleic acid. The relative molecular weight of the homopolymers is generally in the range from 1,000 to 100,000 and that of the copolymers in the range from 2,000 to 200,000 and preferably in the range from 50,000 to 120,000, based on the free acid. Water-soluble polyacrylates crosslinked, for example, with about 1% of a polyallyl ether of sucrose and having a relative molecular weight above 1,000,000 are also particularly suitable. The crosslinked polyacrylates are preferably used in quantities of not more than 1% by weight and more particularly in quantities of 0.2 to 0.7% by weight. The detergents may also contain phosphates.

Besides the auxiliaries and additives described above, the detergents may also contain surfactants selected from anionic, cationic, zwitterionic or nonionic surfactants either on their own or in combination, the use of nonionic surfactants being preferred. The surfactants may be present in total quantities of 1 to 25% by weight, based on the weight of the detergent.

The detergents according to the invention may preferably contain nonionic surfactants. Typical examples of nonionic surfactants are alkoxylates of alkanols, end-capped alkoxylates of alkanols with no free OH groups, alkoxylated fatty acid lower alkyl esters, amine oxides, alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates (more particularly wheat-based vegetable products), polyol fatty acid esters, sugar esters, sorbitan esters and polysorbates. If the nonionic surfactants contain polyglycol ether chains, they may have a conventional homolog distribution although they preferably have a narrow homolog distribution. The other nonionic surfactants are preferably selected from the group consisting of alkoxylates of alkanols, more particularly fatty alcohol polyethylene glycol/polypropylene glycol ethers (FAEO/PO) or fatty alcohol polypropylene glycol/polyethylene glycol ethers (FAPO/EO), end-capped alkoxylates of alkanols, more particularly end-capped fatty alcohol polyethylene glycol/polypropylene glycol ethers or end-capped fatty alcohol polypropylene glycol/polyethylene glycol ethers, and fatty acid lower alkyl esters and amine oxides. In addition, alkyl and/or alkenyl oligoglycosides may preferably be used.

The nonionic surfactants may be present in the detergents according to the invention in quantities of 0.1 to 15% by weight, preferably in quantities of 0.5 to 10% by weight and more particularly in qualities of 1 to 8% by weight, expressed as active substance and based on the detergent.

According to the invention, the detergents according to the invention may also contain anionic surfactants. Typical examples of anionic surfactants are soaps, alkyl benzenesulfonates, secondary alkane sulfonates, olefin sulfonates, alkyl ether sulfonates, glycerol ether sulfonates, α-methyl ester sulfonates, sulfofatty acids, alkyl and/or alkenyl sulfates, alkyl ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids such as, for example, acyl lactylates, acyl tartrates, acyl glutamates and acyl aspartates, alkyl oligoglucoside sulfates, protein fatty acid condensates (particularly wheat-based vegetable products) and alkyl (ether) phosphates. If the anionic surfactants contain polyglycol ether chains, the polyglycol ether chains may have a conventional homolog distribution, although they preferably have a narrow homolog distribution. The anionic surfactants are preferably selected from the group consisting of alkyl and/or alkenyl sulfates, alkyl ether sulfates, alkyl benzenesulfonates, monoglyceride (ether) sulfates and alkanesulfonates, more particularly fatty alcohol sulfates, fatty alcohol ether sulfates, secondary alkanesulfonates and linear alkyl benzenesulfonates.

If anionic surfactants are present, the detergents may contain 0.01 to 20% by weight, preferably 0.25 to 15% by weight and more particularly 0.4 to 10% by weight anionic surfactants, expressed as active substance and based on the detergent. The balance to 100% can be made up by auxiliaries and additives and water.

Other auxiliaries may also be present, including for example inorganic salts, such as sulfates, chlorides, carbonates and hydrogen carbonates. It can also be of advantage to use silicates.

The detergents according to the invention in the second embodiment are preferably offered or produced in solid form which may encompass any type of powder, granules and even tablets and similar shaped bodies. These solid detergents must contain the polyol hydroxyalkyl ethers described above, preferably in quantities of 0.01 to 25% by weight, more preferably in quantities of 1 to 15% by weight and most preferably in quantities of 2 to 10% by weight. The solid detergents in question may be produced by any of the methods known to the expert, for example by granulation, extrusion, spray drying, fluidized bed granulation, press agglomeration, roll compacting, pelleting or tabletting. Besides the polyol alkyl ethers, the solid detergents according to the invention contain other ingredients, preferably surfactants, builders and auxiliaries or additives. For the details and characterization of these ingredients, reference may be made to the foregoing description.

The solid detergents contain polyol hydroxyalkyl ethers and nonionic surfactants in a quantity ratio of preferably 99:1 to 1:99 and more particularly 90:10 to 10:90. However, the ethers and the nonionic surfactants are present in a ratio by weight of 65:35 to 35:65 and more particularly 50:50. It can be of advantage for polymers to be present in granulated detergents, more particularly polyethylene glycols with a molecular weight above 5,000.

In addition, the use of bleaching agents, more particularly peroxide-containing bleaching agents, is preferred. The use of water-softening substances, for example phosphates, polyacrylates and/or other water-softening polymers, more particularly copolymers, is also preferred.

The solid detergents are particularly suitable for cleaning hard surfaces, more particularly as so-called automatic dish detergents (ADDs). The polyol hydroxyalkyl ethers according to the invention are also eminently suitable for improving the drying behavior of dishwashing detergents. By drying behavior is meant the extent to which water, preferably water droplets, is/are still present on the surface of tableware cleaned with a dishwashing detergent at the end of the dishwashing program.

Another aspect of the present invention relates to the use of the polyol hydroxyalkyl ethers described above in detergents, preferably in automatic dish detergents. Compounds corresponding to general formula (I) are particularly preferred. The use of bleaching agents and enzymes is preferred.

The present invention also particularly relates to compositions containing a) 40 to 75%, by weight, of glycerol hydroxyalkyl ethers corresponding to formula (II):

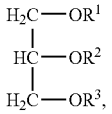

(II)

in which $R^1$, $R^2$ and $R^3$, independently, represent a hydrogen atom or a saturated or unsaturated, branched or unbranched hydroxyalkyl and/or hydroxyalkenyl group containing 10 to 22 carbon atoms, with the proviso that two of the substituents, $R^1$, $R^2$ and $R^3$, represent a hydrogen atom and only one is an hydroxyalkyl or hydroxyalkenyl group, or a mixture thereof, b) 20 to 40%, by weight, of a compound corresponding to formula (II), where at least two of the three substituents, $R^1$, $R^2$ and $R^3$, are hydroxyalkyl or hydroxyalkenyl groups, or mixtures thereof, c) 0 to 10%, by weight, of a compound corresponding to formula (II), where all the substituents, $R^1$, $R^2$ and $R^3$, are hydroxyalkyl or hydroxyalkenyl groups, or mixtures thereof, d) 0 to 20%, by weight, of glycerol, and e) 0 to 10%, by weight, of oligoglycerols, with the proviso that the quantities of components a) to e) add up to 100%, not including small quantities of impurities present from the production process amounting to at most 2%, by weight and preferably less than 1%, by weight.

These compositions are preferably used in detergents, preferably in dishwashing detergents. Compositions containing 2-hydroxyalk(en)yl groups are preferably used. The compositions according to the invention are mixtures of mono-, di- and triglycerol hydroxyethers in which unreacted glycerol or oligoglycerols (component (e) oligomers) may be present from the production process. In this connection, it is essential that the compositions at least contain mono- and diglycerol ethers corresponding to formula (II) in order to obtain the desired effects. Polyol hydroxyethers of formula (II), where the substituents R represent a 2-hydroxyalkyl or alkenyl group (linear alkyl groups being preferred), are preferred.

EXAMPLES

1. Production of A Hydroxyalkyl Polyol Ether According To the Invention 1 mol of a mixture containing $C_{10-16}$ alkyl-α-epoxides was reacted with 3 mol glycerol at elevated temperature in the presence of potassium hydroxide as catalyst. On completion of the reaction, the excess glycerol was distilled off. The remaining end product had the following distribution:

| | |
|---|---|
| monoethers: | 70 to 72% by weight |
| diethers: | 20 to 25% by weight |
| triethers: | <2% by weight |
| glycerol: | <0.5% by weight |

The end product was a wax-like solid with a melting point of 62 to 67° C.

1.1 Production of A Hydroxyalkyl Ether According To the Invention With A High Monoether Content 3 mol glycerol were reacted with 1 mol of a mixture containing $C_{10-16}$ alkyl-α-epoxides at 200 to 220° in the presence of 0.4% by weight potassium hydroxide (based on the quantity of epoxide to be used). The catalyst was then neutralized with lactic acid and part of the excess glycerol was removed by phase separation at 90° C. The remaining glycerol was removed by vacuum distillation at 119-141° C./0.04-0.05 mbar.

Product Composition:

| | |
|---|---|
| monoethers: | 72.2% |
| diethers: | 22.5% |
| triethers: | 1.7% |
| glycerol: | 0.08% |
| others: | 4.32% |

1.2 Production of a Technical Hydroxyalkyl Ether According To the Invention 1 to 1.5 mol glycerol were reacted with 1 mol of a mixture containing $C_{10-16}$ alkyl-α-epoxides at 200 to 220° C. in the presence of 0.4% by weight potassium hydroxide (based on the quantity of epoxide to be used). The catalyst was then neutralized with lactic acid. The product composition changed with the molar ratio of glycerol to epoxide in the following ranges:

| | |
|---|---|
| glycerol: | 0-20% |
| monoethers: | 40-75% |
| diethers: | 20-40% |
| triethers: | 0-10% |

2. Evaluation of Clear Rinse Performance

Clear rinse performance was visually evaluated by examiners. To this end, glasses, cutlery, plastic and china plates were washed in a domestic dishwasher under controlled conditions (water with a hardness of 2, 16 and 21° dH—depending on the formulation, 50 g standard soil in the form of a mixture of (based on 1,000 g) 25 g ketchup, 25 g mustard and 25 g gravy, 300 g margarine, 150 g drinking milk, 15 g potato starch, 9 g egg yolk, 3 g benzoic acid, rest water). The tableware was then evaluated for stains and bloom under controlled light conditions. The results were expressed as "distinctly better (++)/better (+)/same as (0)/ worse (–) than standard", the standard in each test series being 0. The test results are shown in the following Tables where C1 is a comparison test (=standard) and I to XI represent the Examples according to the invention.

The following polyol hydroxyalkyl ethers were tested:

A: $C_{10-16}$ α-hydroxyalkyl glycerol ethers as described in 1.
B: $C_{16}$ α-hydroxyalkyl glycerol ethers
C: $C_{19}$ α-hydroxyalkyl glycerol ethers
D: product A as granules
E: 90% by weight A and 10% by weight PEG 6000

Other surfactants used in the test:

F: $C_{12-14}$ fatty alcohol +5 mol ethylene oxide per mol fatty alcohol
G: hydroxy mixed ether based on an alkoxylated fatty alcohol
H: $C_{8-10}$ alkyl-1,5-glucoside

TABLE 2.0

Solid formulations used in the test (all quantities in % by weight)

| Constituent | Detergent powder 1 | Detergent tablets 2 | "3 in 1" powder 3a | "3 in 1" tablets 3b | "3 in 1" tablets 3c |
|---|---|---|---|---|---|
| Surfactant | 1/2 | 1/2 | 3.5/7 | 3.5/7 | 0 |
| Sodium sulfate | 2 | 0.5 | 2 | 2.5 | 2.5 |
| Sodium silicate | 3 | 0 | 0.5 | 5 | 5 |
| Sodium hydrogen carbonate | 2 | 2 | 8 | 0 | 0 |
| Tetrasodium diphosphate | 1 | 1 | 1 | 1.5 | 1.5 |
| Pentasodium triphosphate | 56.6/55.6 | 66/65 | 54.5/51 | 61.2/57.7 | 64.7 |
| HEDP-Na4 | 0 | 0.2 | 0.5 | 0.5 | 0.5 |
| Benzotriazole | 0.2 | 0.2 | 0.2 | 0 | 0 |
| Na perborate*1$H_2O$ | 0 | 11 | 0 | 12 | 12 |
| Sodium metaborate | 0 | 0.3 | 0 | 0 | 0 |
| TAED | 2 | 3 | 3 | 1.5 | 1.5 |
| Sodium carbonate | 25 | 9 | 15 | 0 | 0 |
| Sodium percarbonate | 5 | 0 | 9 | 0 | 0 |
| Protease | 0.5 | 1.5 | 0.5 | 2.5 | 2.5 |
| Amylase | 1 | 1 | 1 | 2.5 | 2.5 |
| Sodium hydrogen phosphate | 0.5 | 0.2 | 0.2 | 0.2 | 0.2 |
| NaCl | 0.2 | 0.1 | 0.1 | 0.1 | 0.1 |
| Polyethylene glycol (MW 6000) | 0 | 3 | 0 | 2 | 2 |
| Acusol 587, (Rohm & Haas) | 0 | 0 | 1 | 5 | 5 |

2.1 Use in Automatic Dish Detergents

For this test, the polyol alkyl ether according to the invention was incorporated in a detergent powder formulation 1 and was added to the dishwasher at the beginning of the cleaning cycle. The water used had a hardness of 2° dH.

TABLE 2.1a

Clear rinse performance of the products in detergent powder formulation 1

| % by weight AS in the formulation | C1 | I | II | III | IV | V | VI |
|---|---|---|---|---|---|---|---|
| F | 1 | | | | | | |
| A | | 1 | 2 | | | | |
| B | | | | 1 | | | |
| D | | | | | 1 | 2 | |
| A + G (50:50) | | | | | | | 1 |
| Clear rinse performance on | | | | | | | |
| cutlery | 0 | + | + | + | + | + | + |
| china | 0 | 0 | 0 | 0 | 0 | 0 | + |

TABLE 2.1a-continued

Clear rinse performance of the products in detergent powder formulation 1

| % by weight AS in the formulation | C1 | I | II | III | IV | V | VI |
|---|---|---|---|---|---|---|---|
| glass | 0 | 0 | + | 0 | 0 | + | 0 |
| plastic | 0 | 0 | 0 | 0 | 0 | 0 | 0 |

It can be seen from Table 2.1a that the polyol alkyl ethers according to the invention are better as rinse agent components than the comparison surfactant. This was particularly evident from the clear rinse performance on china and cutlery.

2.2 Use as Rinse Agents

For these tests, the particular product was directly added to the dishwasher at the beginning of the final rinse cycle. Water with a hardness of 2° dH was used in these tests.

TABLE 2.2a

Clear rinse performance of the product used with a commercially available powder-form dishwashing detergent

| Addition in g AS | C1 | I | II | III | IV | V |
|---|---|---|---|---|---|---|
| F | 0.6 | | | | | |
| A | | 0.6 | | | | |
| B | | | 0.6 | | | |
| C | | | | 0.6 | | |
| A + F (50:50) | | | | | 0.6 | |
| A + H (50:50) | | | | | | 0.6 |
| Clear rinse performance on | | | | | | |
| cutlery | 0 | + | + | + | + | + |
| china | 0 | 0 | 0 | 0 | 0 | + |
| glass | 0 | 0 | + | 0 | + | 0 |
| plastic | 0 | 0 | 0 | + | 0 | 0 |

TABLE 2.2b

Clear rinse performance of the polyol alkyl ethers according to the invention using a commercially available dishwashing detergent in tablet form:

| Addition in g AS | C1 | I | II | III | IV | V |
|---|---|---|---|---|---|---|
| F | 0.6 | | | | | |
| A | | 0.6 | | | | |
| B | | | 0.6 | | | |
| C | | | | 0.6 | | |
| A + F (50:50) | | | | | 0.6 | |
| A + H (50:50) | | | | | | 0.6 |
| Clear rinse performance on | | | | | | |
| cutlery | 0 | + | + | + | + | + |
| china | 0 | 0 | 0 | 0 | 0 | + |
| glass | 0 | 0 | 0 | 0 | + | 0 |
| plastic | 0 | 0 | 0 | + | 0 | 0 |

It can be seen from Tables 2.2a and 2.2b that the compounds according to the invention are better as rinse agent components than the comparison surfactant. This is evident in particular from their clear rinse performance on china and cutlery.

2.3 Use in 2-in-1 Formulations

For these tests, the particular product was a) incorporated in a detergent powder formulation 1,
b) incorporated in a detergent tablet formulation 2 and then tabletted,
c) separately added to the dishwasher in addition to a detergent tablet at the beginning of the cleaning cycle.

TABLE 2.3a

| | Clear rinse performance of the products incorporated in the detergent powder formulation 1: | | | | | | | | | | | |
|---|---|---|---|---|---|---|---|---|---|---|---|---|
| % by wt. AS in the formulation | C1 | I | II | III | IV | V | VI | VII | VIII | IX | X | XI |
| F | 3.5 | | | | | | | | | | | |
| A | | 3.5 | 7 | | | | | | | | | |
| B | | | | 3.5 | | | | | | | | |
| C | | | | | 3.5 | | | | | | | |
| D | | | | | | 3.5 | 7 | | | | | |
| E | | | | | | | | 3.5 | | | | |
| A + F (50:50) | | | | | | | | | 3.5 | | | |
| A + G (50:50) | | | | | | | | | | 3.5 | 7 | |
| A + H (50:50) | | | | | | | | | | | | 3.5 |
| Clear rinse performance on | | | | | | | | | | | | |
| cutlery | 0 | + | + | + | 0 | + | + | 0 | + | + | + | + |
| china | 0 | + | + | + | 0 | + | + | + | 0 | + | ++ | + |
| glass | 0 | 0 | + | + | 0 | 0 | + | 0 | 0 | + | + | 0 |
| plastic | 0 | 0 | 0 | 0 | + | 0 | 0 | 0 | 0 | 0 | 0 | 0 |

TABLE 2.3b

| | Clear rinse performance of the products incorporated in the detergent tablet formulation 2 as a pressed tablet | | | | | | | | | | | |
|---|---|---|---|---|---|---|---|---|---|---|---|---|
| % by wt. AS in the formulation | C1 | I | II | III | IV | V | VI | VII | VIII | IX | X | XI |
| F | 3.5 | | | | | | | | | | | |
| A | | 3.5 | 7 | | | | | | | | | |
| B | | | | 3.5 | | | | | | | | |
| C | | | | | 3.5 | | | | | | | |
| D | | | | | | 3.5 | 7 | | | | | |
| E | | | | | | | | 3.5 | | | | |
| A + F (50:50) | | | | | | | | | 3.5 | | | |
| A + G (50:50) | | | | | | | | | | 3.5 | 7 | |
| A + H (50:50) | | | | | | | | | | | | 3.5 |
| Clear rinse performance on | | | | | | | | | | | | |
| cutlery | 0 | + | + | + | + | + | + | 0 | + | + | + | + |
| china | 0 | + | + | + | 0 | + | + | + | 0 | + | ++ | + |
| glass | 0 | 0 | + | 0 | 0 | 0 | + | 0 | 0 | + | ++ | 0 |
| plastic | 0 | 0 | 0 | 0 | + | 0 | 0 | 0 | 0 | 0 | 0 | + |

TABLE 2.3c

| | Clear rinse performance when the products are simultaneously, but separately added to a tablet of a commercially available dishwashing detergent: | | | | | | | | | | | |
|---|---|---|---|---|---|---|---|---|---|---|---|---|
| Addition in g AS | V1 | I | II | III | IV | V | VI | VII | VIII | IX | X | XI |
| F | 3.5 | | | | | | | | | | | |
| A | | 3.5 | 7 | | | | | | | | | |
| B | | | | 3.5 | | | | | | | | |
| C | | | | | 3.5 | | | | | | | |
| D | | | | | | 3.5 | 7 | | | | | |
| E | | | | | | | | 3.5 | | | | |
| A + F (50:50) | | | | | | | | | 3.5 | | | |
| A + G (50:50) | | | | | | | | | | 3.5 | 7 | |
| A + H (50:50) | | | | | | | | | | | | 3.5 |
| Clear rinse performance on | | | | | | | | | | | | |
| cutlery | 0 | + | + | + | + | + | + | 0 | + | + | + | + |
| china | 0 | + | + | + | 0 | + | + | + | 0 | + | ++ | + |
| glass | 0 | 0 | + | 0 | 0 | 0 | + | 0 | 0 | + | ++ | 0 |
| plastic | 0 | 0 | 0 | 0 | + | 0 | 0 | 0 | 0 | 0 | 0 | + |

It can clearly be seen from Table 2.3a to 2.3c that the surfactants according to the invention are far better as rinse agent components than the comparison surfactant. This is evident in particular from their clear rinse performance on china and cutlery.

2.4 Uses In 3-In-1 Formulations

The tests with 3-in-1 formulations were carried out with water having a hardness of 21°dH. For these tests, the particular product was a) incorporated in a 3-in-1 powder formulation 3a,
b) incorporated in a 3-in-1 tablet formulation 3b and then tabletted,
c) separately added to the dishwasher in addition to a 3-in-1 tablet (tablet formulation 3c) at the beginning of the cleaning cycle.

TABLE 2.4a

Clear rinse performance of the products incorporated in the 3-in-1 powder formulation 3a

| % by wt. AS in the formulation | C1 | I | II | III | IV | V | VI | VII | VIII | IX | X | XI |
|---|---|---|---|---|---|---|---|---|---|---|---|---|
| F | 3.5 | | | | | | | | | | | |
| A | | 3.5 | 7 | | | | | | | | | |
| B | | | | 3.5 | | | | | | | | |
| C | | | | | 3.5 | | | | | | | |
| D | | | | | | 3.5 | | | | | | |
| E | | | | | | | 3.5 | | | | | |
| A + F (20:80) | | | | | | | | 3.5 | 7 | | | |
| A + G (50:50) | | | | | | | | | | 3.5 | 7 | |
| A + H (50:50) | | | | | | | | | | | | 3.5 |
| Clear rinse performance on | | | | | | | | | | | | |
| cutlery | 0 | + | + | + | 0 | + | + | + | + | + | + | + |
| china | 0 | + | + | + | 0 | + | + | 0 | + | 0 | + | + |
| glass | 0 | 0 | + | + | 0 | 0 | 0 | 0 | + | + | + | 0 |
| plastic | 0 | 0 | 0 | 0 | + | 0 | 0 | 0 | 0 | 0 | 0 | + |

TABLE 2.4b

Clear rinse performance of the products incorporated in the 3-in-1 tablet formulation 3b as a pressed tablet

| % by wt. AS in the formulation | C1 | I | II | III | IV | V | VI | VII | VIII | IX | X | XI |
|---|---|---|---|---|---|---|---|---|---|---|---|---|
| F | 3.5 | | | | | | | | | | | |
| A | | 3.5 | 7 | | | | | | | | | |
| B | | | | 3.5 | | | | | | | | |
| C | | | | | 3.5 | | | | | | | |
| D | | | | | | 3.5 | | | | | | |
| E | | | | | | | 3.5 | | | | | |
| A + F (50:50) | | | | | | | | 3.5 | 7 | | | |
| A + G (20:80) | | | | | | | | | | 3.5 | 7 | |
| A + H (50:50) | | | | | | | | | | | | 3.5 |
| Clear rinse performance on | | | | | | | | | | | | |
| cutlery | 0 | 0 | + | 0 | + | + | + | + | + | + | + | + |
| china | 0 | + | + | 0 | + | + | + | 0 | 0 | 0 | + | 0 |
| glass | 0 | 0 | 0 | 0 | 0 | + | + | 0 | + | + | ++ | 0 |
| plastic | 0 | 0 | 0 | + | 0 | 0 | 0 | 0 | 0 | 0 | 0 | 0 |

TABLE 2.4c

Clear rinse performance of the products when simultaneously, but separately added to a tablet of the 3-in-1 tablet formulation 3c

| Addition in g AS | C1 | I | II | III | IV | V | VI |
|---|---|---|---|---|---|---|---|
| F | 0.6 | | | | | | |
| A | | 0.6 | 1.0 | | | | |
| B | | | | 0.6 | | | |
| C | | | | | 0.6 | | |
| A + F (50:50) | | | | | | 0.6 | |
| A + H (50:50) | | | | | | | 0.6 |

TABLE 2.4c-continued

Clear rinse performance of the products when simultaneously, but separately added to a tablet of the 3-in-1 tablet formulation 3c

| Addition in g AS | C1 | I | II | III | IV | V | VI |
|---|---|---|---|---|---|---|---|
| Clear rinse performance on | | | | | | | |
| cutlery | 0 | + | + | + | + | + | 0 |
| china | 0 | + | + | + | 0 | + | + |
| glass | 0 | 0 | + | + | 0 | + | + |
| plastic | 0 | 0 | 0 | 0 | + | 0 | 0 |

It can be seen from Table 2.4a to 2.4c that the surfactants according to the invention are better as rinse agent components than the comparison surfactant. This is evident in particular from their clear rinse performance on china and cutlery.

3. Drying Performance

Drying performance was evaluated by counting the droplets still adhering to the tableware. To this end, glasses, cutlery, plastic and china plates were washed under controlled conditions (water hardness 21°dH, 50 g standard soil) in a domestic dishwasher. On completion of the dishwashing program, the number of droplets on the tableware was counted under controlled light conditions. The results were expressed as "distinctly better (++)/better (+)/same as (0)/worse (−) than standard", the standard in each test series being 0. The test results are shown in the following Tables where C1 is a comparison test (=standard) and I to V represent the Examples according to the invention.

3.1 Uses In 3-In-1 ADD Formulations

For these tests, the particular product was a) incorporated in a 3-in-1 powder formulation 3a, b) incorporated in a 3-in-1 tablet formulation 3b and then tabletted, c) separately added to the dishwasher in addition to a 3-in-1 tablet (tablet formulation 3c) at the beginning of the cleaning cycle.

TABLE 3.1a

Drying performance of the products incorporated in the 3-in-1 powder formulation 3a

| % AS in the formulation | C1 | I | II | III | IV | V | VI | VII |
|---|---|---|---|---|---|---|---|---|
| F | 3.5 | | | | | | | |
| A | | 3.5 | 7 | | | | | |
| B | | | | 3.5 | | | | |
| D | | | | | 3.5 | 7 | | |
| A + G (20:80) | | | | | | | 3.5 | 7 |
| Drying performance on | | | | | | | | |
| cutlery | 0 | + | ++ | + | + | ++ | + | + |
| china | 0 | + | ++ | + | + | + | + | + |
| glass | 0 | 0 | + | + | + | + | + | ++ |
| plastic | 0 | 0 | + | 0 | 0 | + | 0 | + |

TABLE 3.1b

| % by wt. AS in the formulation | C1 | I | II | III | IV | V | VI |
|---|---|---|---|---|---|---|---|
| F | 3.5 | | | | | | |
| A | | 3.5 | 7 | | | | |
| C | | | | 3.5 | | | |
| D | | | | | 3.5 | 7 | |
| A + H (50:50) | | | | | | | 3.5 |
| Drying performance on | | | | | | | |
| cutlery | 0 | + | ++ | + | + | ++ | + |
| china | 0 | + | ++ | + | + | ++ | 0 |
| glass | 0 | + | + | + | + | + | + |
| plastic | 0 | 0 | + | + | 0 | 0 | 0 |

TABLE 3.1c

Drying performance of the products when simultaneously, but separately added to a tablet of the 3-in-1 tablet formulation 3c

| Addition in g AS | C1 | I | II | III | IV | V | VI |
|---|---|---|---|---|---|---|---|
| F | 0.6 | | | | | | |
| A | | 0.6 | 1.0 | | | | |
| B | | | | 0.6 | | | |
| C | | | | | 0.6 | | |
| A + F (20:80) | | | | | | 0.6 | 1 |
| Drying performance on | | | | | | | |
| cutlery | 0 | + | ++ | + | + | 0 | + |
| china | 0 | + | ++ | + | + | + | + |
| glass | 0 | + | ++ | + | + | + | ++ |
| plastic | 0 | 0 | 0 | 0 | + | 0 | 0 |

It is clear from Tables 3.1a to 3.1c that the surfactants according to the invention are better as components for improving drying performance than the comparison surfactant. This is evident in particular from their drying performance on china and cutlery.

What is claimed is:

1. A composition comprising:

a) 40 to 75%, by weight, of glycerol hydroxyalkyl ethers corresponding to formula (II):

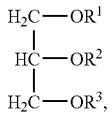

(II)

in which each of $R^1$, $R^2$ and $R^3$, independently of one another, represents a hydrogen atom or, independently in each molecule, an hydroxyalkyl or an hydroxyalkenyl group, each group containing 10 to 22 carbon atoms, with the proviso that each of two of the substituents, $R^1$, $R^2$ and $R^3$, represents a hydrogen atom;

b) 20 to 40%, by weight, of a compound corresponding to formula (II), where each of at least two of the three substituents, $R^1$, $R^2$ and $R^3$, is, independently, an hydroxyalkyl or an hydroxyalkenyl group, or mixtures thereof;

c) 0 to 10%, by weight, of a compound corresponding to formula (II), where each of the substituents, $R^1$, $R^2$ and $R^3$, is, independently, an hydroxyalkyl or an hydroxyalkenyl group, or mixtures thereof;

d) 0 to 20%, by weight, of glycerol; and e) 0 to 10%, by weight, of oligoglycerols, with the proviso that the quantities of components a) to e) add up to 100%.

2. The composition according to claim 1, wherein each hydroxyalkyl and hydroxyalkenyl group is independently selected, respectively, from saturated or unsaturated, branched or unbranched hydroxyalkyl and hydroxyalkenyl groups, or mixtures thereof, each group containing 10 to 18 carbon atoms.

3. The composition according to claim 2, wherein each hydroxyalkyl and hydroxyalkenyl group is saturated and unbranched.

4. The composition according to claim 1, additionally comprising water; an acid, selected from mono-, di- and tri-carboxylic acids, each having 2 to 6 carbon atoms; and one or more solubilizers selected from the group consisting of cumene sulfonate, unbranched $C_{6-10}$ n-alkyl sulfates, ethanol, propanol, butanol, and isomers of propanol or butanol.

5. The composition according to claim 4, wherein the solubilizer is cumene sulfonate, and the acid is selected from the group consisting of citric, malic, tartaric, oxalic, malonic, succinic, glutaric, and adipic acids.

6. The composition according to claim 4, additionally comprising: one or more non-aqueous solvents selected from one or more polyethylene glycols having molecular weights of 600 to 35,000; and one or more nonionic surfactants selected from fatty alcohol alkoxylates, hydroxy mixed ethers and alkyl (oligo)glycosides, wherein the ratio of glycerol hydroxyalkyl ethers to nonionic surfactants is 90:10 to 10:90, by weight.

7. The composition according to claim 1, wherein each hydroxyalkyl group in formula (II) is a 2-hydroxyalkyl group and each hydroxyalkenyl group in formula (II) is a 2-hydroxyalkenyl group.

8. The composition according to claim 1, comprising $C_{10-16}$ α-hydroxyalkyl glycerol ethers in which 70 to 72% are monoethers, 20 to 25% are diethers, less than 2% are triethers and less than 0.5% is glycerol, by weight, based on the weight of the composition.

9. A solid automatic dishwashing detergent comprising a composition according to claim 1.

10. A detergent composition comprising, based on the weight of the detergent composition, (a) 10 to 90%, by weight, of water; (b) 1 to 15%, by weight, of one or more glycerol hydroxyalkyl ethers corresponding to formula (II):

(II)

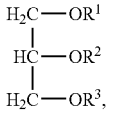

wherein the substituents, R1, R2, and R3, jointly, are selected from the group consisting of (i) each of $R^1$, $R^2$ and $R^3$, independently of one another, representing a hydrogen atom or, independently in each molecule, an hydroxyalkyl or an hydroxyalkenyl group, each group containing 10 to 22 carbon atoms, with the proviso that each of two of the substituents, $R^1$, $R^2$ and $R^3$, representing a hydrogen atom; and (ii) each of at least two of the three substituents, $R^1$, $R^2$ and $R^3$, is, independently, an hydroxyalkyl or an hydroxyalkenyl group, or mixtures thereof; (c) 1 to 5%, by weight in the aggregate, of one or more solubilizers; (d) 1 to 5%, by weight, of an acid; (e) 1 to 50%, by weight in the aggregate, of one or more non-aqueous solvents; (f) 0.1 to 15%, by weight, of one or more nonionic surfactants; (g) 0.1 to 10%, by weight, of at least one enzyme, obtained from *Bacillus lentus*; and (h) 0.1 to 40%, by weight, of at least one bleaching agent.

11. The detergent composition according to claim 10, additionally comprising water-softening substances comprising phosphates or polyacrylates.

* * * * *